US006087891A

United States Patent [19]

Yoon et al.

[11] Patent Number: 6,087,891

[45] Date of Patent: Jul. 11, 2000

[54] INTEGRATED POWER SUPPLY VOLTAGE GENERATORS HAVING REDUCED SUSCEPTIBILITY TO PARASITIC LATCH-UP DURING SET-UP MODE OPERATION

[75] Inventors: Sei-Seung Yoon; Yong-Cheol Bae, both of Seoul, Rep. of Korea

[73] Assignee: Samsung Electronics Co., Ltd., Rep. of Korea

[21] Appl. No.: 09/160,073

[22] Filed: Sep. 24, 1998

[30] Foreign Application Priority Data

Sep. 25, 1997 [KR] Rep. of Korea ..... 97-48827

[51] Int. Cl.[7] ..... G05F 1/10

[52] U.S. Cl. ..... 327/530; 327/536

[58] Field of Search ..... 327/530, 534, 327/535, 536, 537, 390, 333

[56] References Cited

U.S. PATENT DOCUMENTS

| | | | |
|---|---|---|---|
| 5,189,316 | 2/1993 | Murakami et al. | 327/530 |
| 5,442,277 | 8/1995 | Mori et al. | 327/530 |
| 5,483,486 | 1/1996 | Javanifard et al. | 327/536 |
| 5,488,327 | 1/1996 | Okada | 327/536 |
| 5,796,293 | 8/1998 | Yoon et al. | 327/536 |

*Primary Examiner*—Toan Tran

*Attorney, Agent, or Firm*—Myers Bigel Sibley & Sajovec

[57] ABSTRACT

Integrated power supply voltage generators include a boosted voltage generator which generates a boosted voltage signal (Vpp) at a first level on a boosted voltage signal line during a set-up time interval, in response to an internal power supply voltage signal (VINTA*), and a circuit which is responsive to a first reference voltage (VREFA) and the boosted voltage signal (Vpp) and generates the internal power supply voltage signal (VINTA*) at a second level which is less than the first level throughout the set-up time interval.

6 Claims, 6 Drawing Sheets

INTEGRATED POWER SUPPLY VOLTAGE GENERATORS HAVING REDUCED SUSCEPTIBILITY TO PARASITIC LATCH-UP DURING SET-UP MODE OPERATION

FIELD OF THE INVENTION

The present invention relates to integrated circuit power supplies, and more particularly to integrated circuit power supplies which are suitable for powering integrated circuit memory devices.

BACKGROUND OF THE INVENTION

In general, a semiconductor memory device uses an internal power supply voltage which is properly converted and adjusted from an external power supply voltage and applied to internal circuits.

In a semiconductor memory device which may be portioned into two regions of memory arrays and peripheral circuits, as shown in FIG. 1, each of the regions has an independent power supply voltage to be free from mutual influence of powering between the memory arrays and peripheral circuits. Therefore, the internal power supply voltages are substantially divided into one for memory arrays, one for peripheral circuits and one for data buffers, and levels of those voltages are independently established in accordance with conditions of power consumption at the regions. Internal power supply voltage generating circuit 10, as shown in FIG. 1, makes VINTA, internal power supply voltage for the memory arrays (hereinafter referred to as "array power supply voltage"), with VREFA that is reference voltage for the memory arrays (hereinafter referred to as "array reference voltage"), from external power supply voltage (hereinafter referred to as "Vcc"). Boosted voltage Vpp is generated from boosting circuit 20 which uses VINTA as a source voltage. The memory array region is formed of a plurality of cell arrays, including sense amplifiers and word line drivers (or sub word line drivers), in a SWD (sub-word-line-driver) architecture. Referring to FIG. 2 disclosing a magnified configuration of the encircled portion in FIG. 1, there are conjunction regions between the sense amplifiers and sub word line drivers. The conjunction regions, for instance, of a dynamic random access memory device, contains signal lines and power lines for operating core circuits, such as the sense amplifiers and drivers, in the cell arrays. As shown in FIG. 2, in the conjunction region, the boosted voltage Vpp is contacted into a N-well to be used as a well bias voltage therein and VINTA is connected to a P+ doped region formed in the N-well. It is well known that the Vpp is to be applied to a pair of isolation gates which is interposed between a cell array and a bit line sense amplifier consisting of P- and N-latches for the purpose of compensating a voltage drop of a data signal due to a word line voltage, and to the word line driver and a clock driver, of a DRAM or a SRAM. The applying of Vpp into the N-well is provided to reduce an influence by a latch-up effect, which can more stabilize a switching operation of a PMOS transistor which uses the N-well as a bulk region of itself.

When, like the configuration of FIG. 2, Vpp is simply applied to the N-well of bulk region of the PMOS transistor, a sectional view corresponding to FIG. 2 can be illustrated as shown in FIG. 3. VINTA generated from circuit 10 is connected to the P+ doped region (or active region) which may be a source of the PMOS transistor, and Vpp is connected to N+ doped region which is formed in the N-well, together with the P+ active region, in P-substrate.

With such a connecting state, as shown in the graph of FIG. 4, since there is period Tf, within a set-up time, for which the level of Vpp is being increased, but still below that of VINTA, a forward bias path through parasitic diode D1 is inevitably formed from the P+ doped region to the N+ doped region during the period Tf, causing the latch-up phenomenon. Such an occurrence of current flowing through the forward-biased parasitic diode from VINTA to Vpp during Tf after a power-up of a memory device (i.e., the latch-up) may destroy the PMOS transistors used for pull-up transistors in a number of internal circuits, and degrades the livability and reliability of driving performance of the PMOS transistors, resulting in malfunctions of circuit operations in the memory device.

In order to overcome the aforementioned limit in obviating the latch-up, FIG. 5 shows a general example of circuit, including internal power supply voltage generating circuit 10 and one of internal circuits which is disposed with benefit of the application of latch-up protection. Circuit 10 is the type of a differential amplifier which has input terminals connected to array reference voltage VREFA and array power supply voltage VINTA, uses external power supply voltage VEXT as a source and includes a NMOS transistor which is connected to ground voltage Vss and controlled by VEXT. Array power supply voltage VINTA, as an output of the circuit 10, is applied to internal circuits 12 and 14 as power sources. Internal circuit 14 having input C and output D is connected to VINTA through NMOS transistor LNT which is provided to reduce the latch-up effect in the circuit 14, while another internal circuit 12 having input A and output B has not any means to protect itself from the latch-up effect. In circuit 14, bulk of NMOS transistor LNT is held into Vss and gate of LNT is connected to Vpp together with bulk of PMOS transistor PT1. Since the source of PMOS transistor PT1 is connected to VINTA through channel region of NMOS transistor LNT whose gate is connected to Vpp, not being connected directly to VINTA as the former case does, the forward-biased parasitic diode D1 shown in FIG. 3 can not be created therein because a voltage level at the source of PT1, appearing over NMOS transistor LNT, becomes lower than that of Vpp even in the Tf. It is possible to apply the designed configuration shown in FIG. 5 commonly to a memory device including a construction of triple well in which Vpp and VINTA are independently utilized into well bias voltages.

However, in substantial, since the NMOS transistor (e.g., LNT) for protecting the latch-up should be assigned to almost all of the internal circuit such as 14, further regions for the latch-up protection transistors are in need and thereby it is inevitable to enlarge a width for layout.

SUMMARY OF THE INVENTION

The present invention is intended to solve the problems. And, it is an object of the invention to provide an internal power supply voltage generating circuit capable of making a memory device be protected from a latch-up phenomenon, without increasing a lay-out width.

It is another object of the invention to provide an internal power supply voltage generating circuit used in a semiconductor memory device employing a boosted voltage, capable of stabilizing an apply of an internal power supply voltage even when the boosted voltage is lower than the internal power supply voltage, without a lay-out width.

It is still another object of the invention to provide a semiconductor memory device having a stabilized environment of voltage biasing with using an internal power supply voltage and a boosted voltage.

In order to accomplish those objects, the internal power voltage generating circuit includes a comparing circuit having an input terminal connected to the internal power source voltage and an output terminal connected to a transistor which charges the internal power source voltage, and a transistor connected between a reference voltage and another input of the comparing circuit.

Another aspect of the invention is to provide a semiconductor memory device employing a boosted voltage, including: an internal circuit including a PMOS transistor whose source is connected to an internal power source voltage and whose bulk is connected to the boosted voltage; a circuit for generating the internal power source voltage, including a comparing circuit having an input terminal connected to the internal power source voltage and an output terminal connected to a transistor which charges the internal power source voltage, and a transistor connected between a reference voltage and another input of the comparing circuit. The invention accomplishes a latch-up protection without enlarging a lay-out width.

BRIEF DESCRIPTION OF THE DRAWINGS

For a better understanding of the invention, and to show how embodiments of the same may be carried into effect, reference will now be made, by way of example, to the accompanying diagrammatic drawings, in which.

In the figures, like reference numerals denote like or corresponding parts.

DESCRIPTION OF PREFERRED EMBODIMENTS

The present invention will now be described more fully hereinafter with reference to the accompanying drawings, in which preferred embodiments of the invention are shown. This invention may, however, be embodied in different forms and should not be construed as limited to the embodiments set forth herein. Rather, these embodiments are provided so that this disclosure will be thorough and complete, and will fully convey the scope of the invention to those skilled in the art. Like numbers refer to like elements throughout and signal lines and signals thereon may referred to by the same reference symbols.

Figure 6:
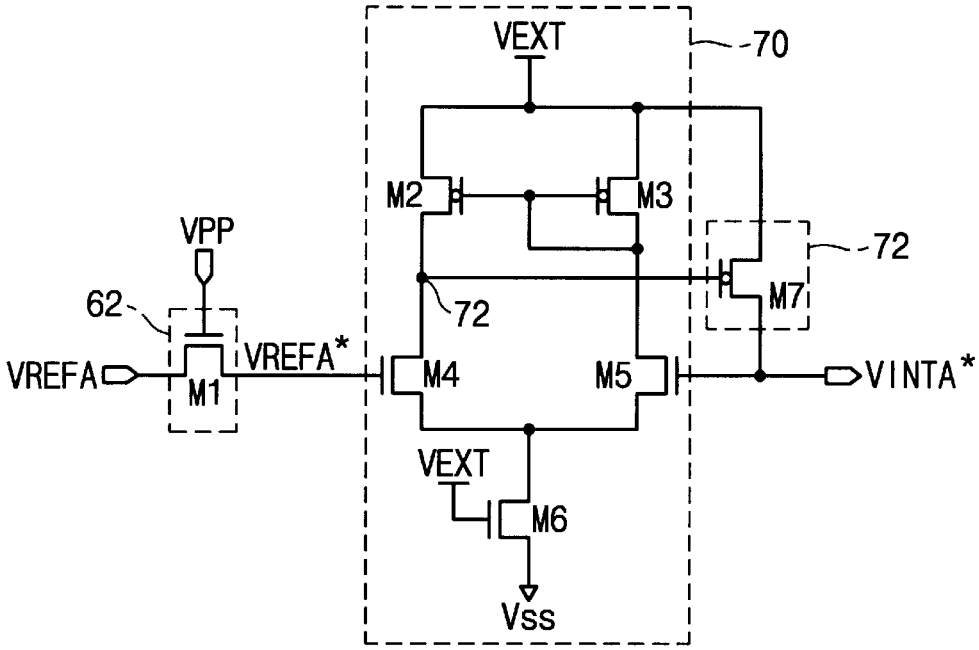
FIG. 6 is an internal power supply voltage generating circuit of the invention.

FIG. 6 shows an internal power supply voltage generating circuit preferred to the invention. Referring to FIG. 6, the internal power supply generating circuit is constructed of loading section 62, comparing section 70 and driving section 72. Comparing section is formed of a differential amplifier connected to external power supply voltage VEXT and to ground voltage Vss through NMOS transistor M6 whose gate is coupled to VEXT. In the differential amplifier, sources of PMOS transistors M2 and M3 are connected to VEXT in common, NMOS transistor M4 is connected between drain of PMOS transistor M2 and drain of NMOS transistor M6, and NMOS transistor M5 is connected between drain of PMOS transistor M3 and the drain of NMOS transistor M6. Gates of PMOS transistors M2 and M3 are commonly coupled to node 74 that is also connected to drain of NMOS transistor M5. Node 72 positioned at the drain of PMOS transistor M2 (or drain of NMOS transistor M4) is coupled to gate of PMOS transistor M7 of driving section 72. PMOS transistor M7 is connected between VEXT and VINTA* that is an output of the present internal power supply voltage generating circuit. VINTA* is also coupled to gate of NMOS transistor M5. Gate of NMOS transistor M4 is coupled to array reference voltage VREFA through NMOS transistor M1 of loading section 62. Gate of NMOS transistor M1 is held in boosted voltage Vpp. Exemplary circuits for generating boosted voltage signals are described in U.S. Pat. No. 5,796,293 to Yoon et al, entitled "Voltage Boosting Circuits Having Backup Voltage Boosting Capability", assigned to the present assignee, the disclosure of which is hereby incorporated herein by reference. Exemplary circuits for generating reference voltages are also described in U.S. application Ser. No. 09/160073, to Yoon et al., filed Sep. 4, 1998, entitled "Integrated Circuit Devices Having Improved Internal Voltage Generators Which Reduce Timing Skew in Buffer Circuits Therein" (Attorney Docket No. 5649-628), assigned to the present assignee, the disclosure of which is hereby incorporated herein by reference.

A modified array reference voltage VREFA* directly applied to the gate of NMOS transistor M4 is made from a voltage drop through NMOS transistor M1 with VREFA, being established into the level of Vpp-Vth (Vth is threshold voltage of NMOS transistor M1). Thus, NMOS transistor M1 acts as a resistance in view of the gate of NMOS transistor M4 which is an input terminal of the differential amplifier. NMOS transistor M6 is designed to connect the differential amplifier to Vss when VEXT rises up to a voltage level enough to turn on it. Node 72 becomes an output terminal of the differential amplifier and the other input terminal is the gate of NMOS transistor M5 which is also assigned to an terminal port for VINTA*. PMOS transistor M7 controls the amount of current supplied from VEXT to VINTA* in response to a voltage level at node 72. In an operation of the differential amplifier, output node 72 goes to low level when a present level of VINTA* is lower than that of VREFA*, or to high level when VINTA* is higher than VREFA*.

Figure 1:
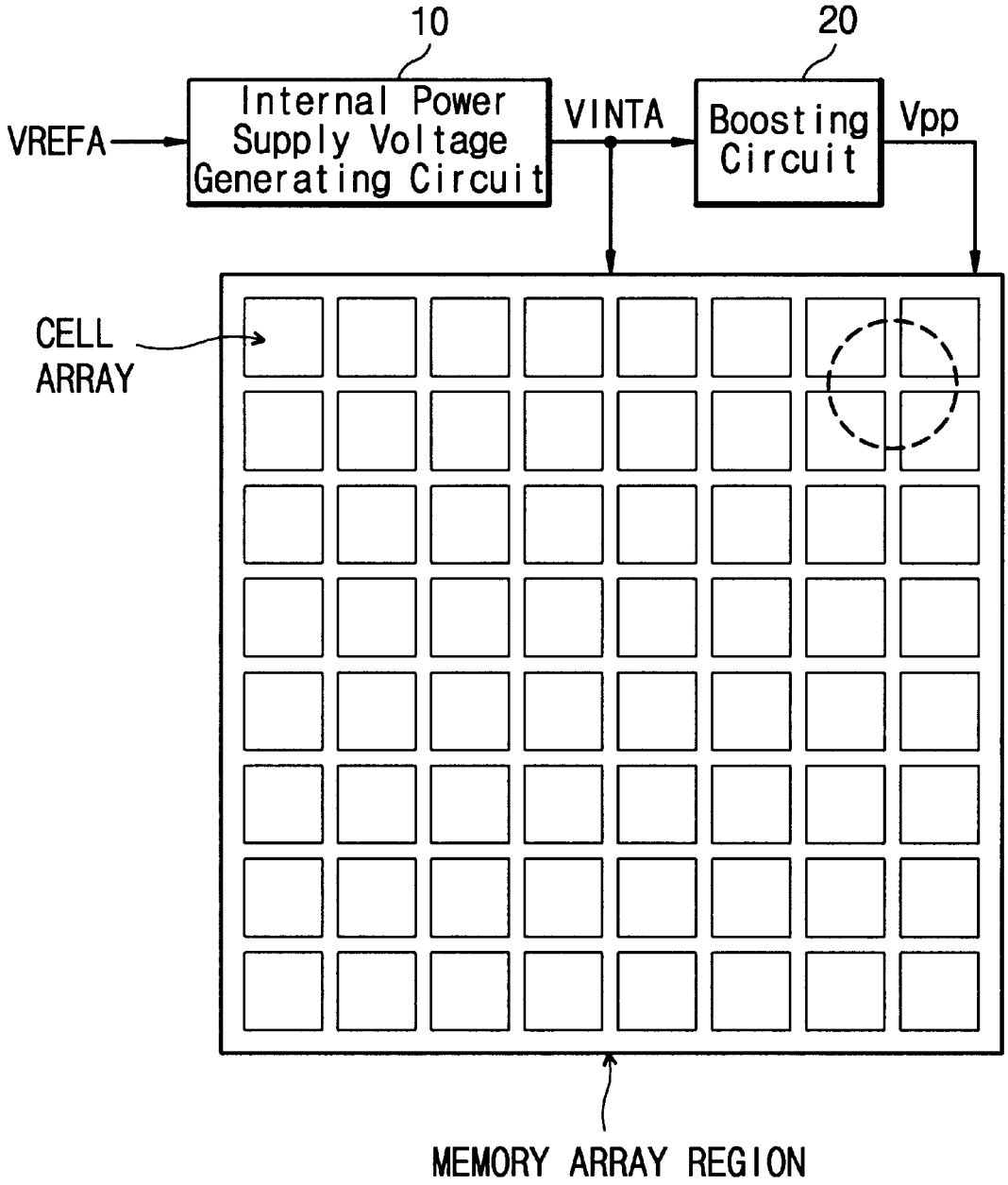
Fig. 1 (PRIOR ART)
FIG. 1 is a schematic illustrating a general configuration of supplying power supply voltages into a memory array region of a semiconductor memory device.
Figure 2:
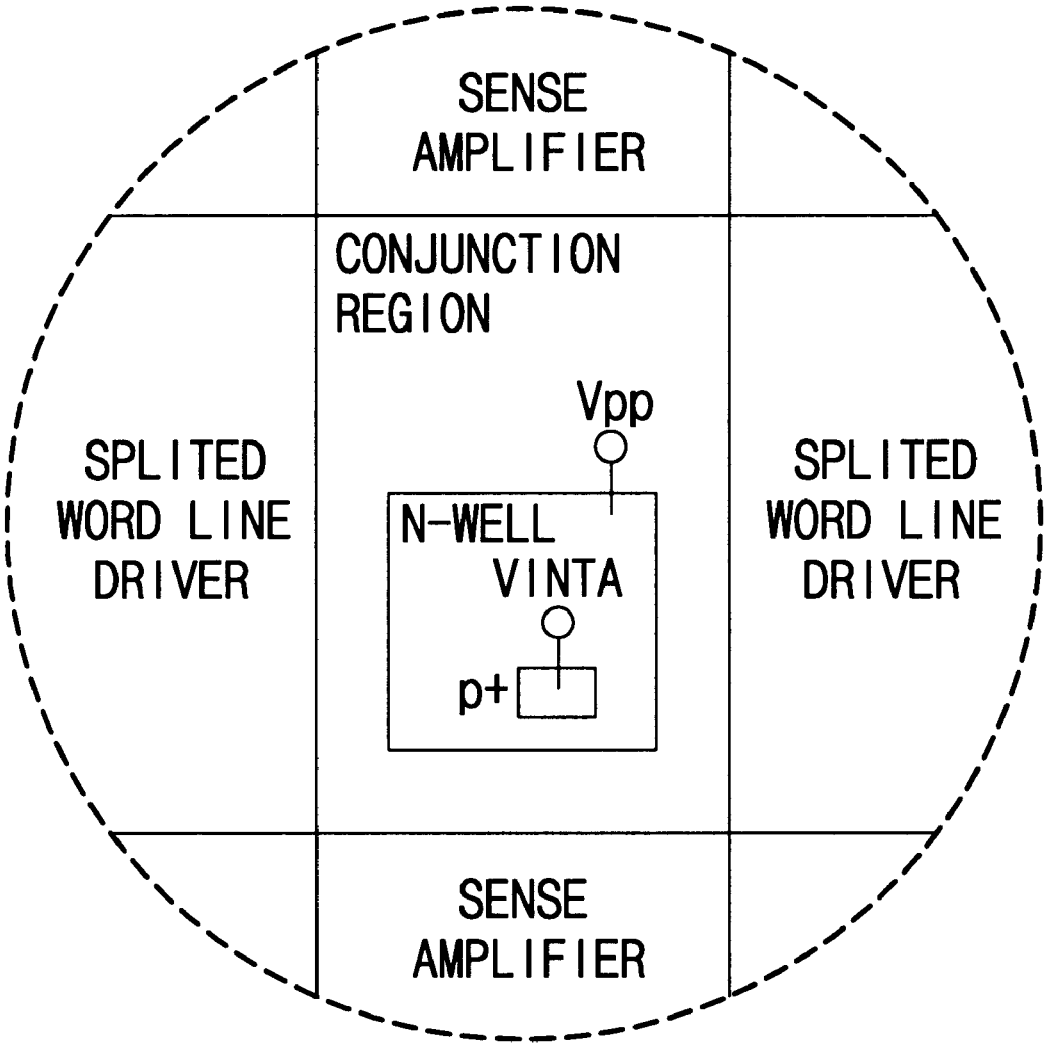
Fig. 2 (PRIOR ART)
FIG. 2 is an enlargement of the portion encircled by a broken line in FIG. 1, showing a conventional example of biasing configuration for protecting a latch-up phenomenon.
Figure 3:
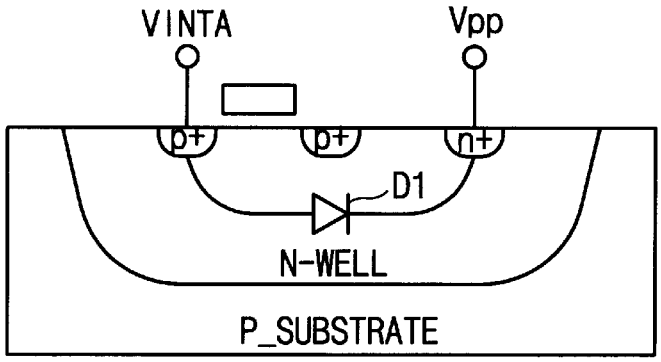
Fig. 3 (PRIOR ART)
FIG. 3 is a sectional illustration for showing a mechanism of the latch-up in PMOS transistor formed in a N-well, in conjunction with FIG. 2.
Figure 7:
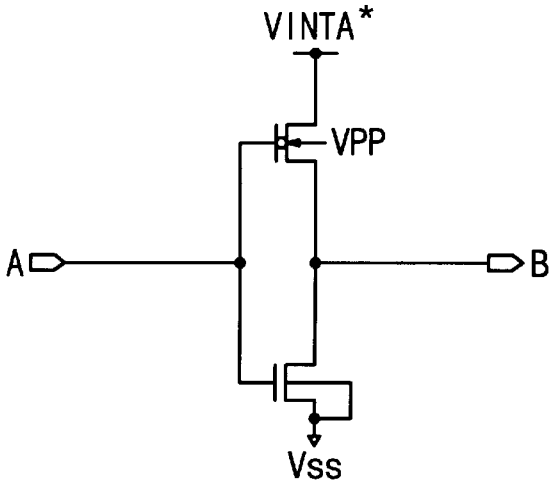
FIG. 7 shows a typical configuration of an inverter circuit coupled with an internal power supply voltage an output of the generating circuit of FIG. 6, and a boosted voltage, which is preferred to prevent the latch-up effect.

FIG. 7 shows an application feature with VINTA* generated from the circuit of FIG. 6. The circuit of FIG. 7 is an internal circuit which has input A and output B, and is constructed of PMOS transistor and NMOS transistor whose gates are coupled to the input A in common. In the internal circuit of FIG. 7, source of the PMOS transistor is connected to VINTA*, drains of the PMOS and NMOS transistors are connected to the output B, and source of the NMOS transistor is connected to Vss. And Vpp is applied to bulk of the PMOS transistor as a well bias voltage. As is in FIG. 3, the bulk of the PMOS transistor is formed of a N-well defined in a P-substrate. It should be noted that an internal circuit to which VINTA* created from the circuit of FIG. 6 may be any one that includes a PMOS transistor used for a pull-up element.

Figure 4:
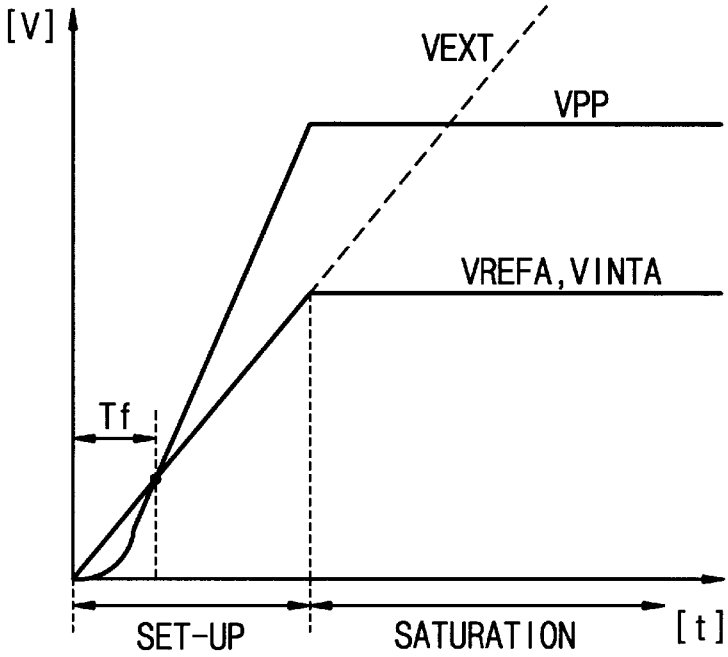
Fig. 4 (PRIOR ART)
FIG. 4 is a graphic diagram showing the variations of a reference voltage, an internal power supply voltage and a boosted voltage, according to an increase of an external power supply voltage.
Figure 5:
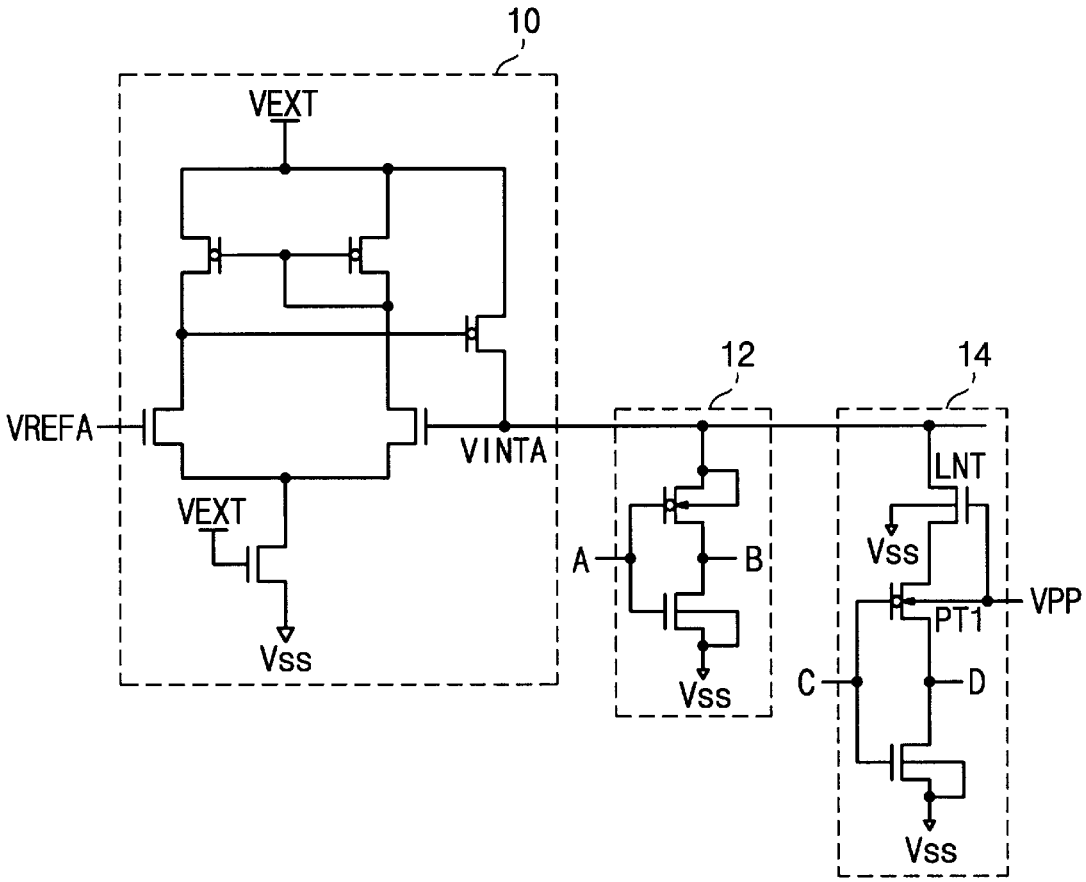
Fig. 5 (PRIOR ART)
FIG. 5 shows a conventional circuit having a latch-up preventing function, being constructed with an internal power supply voltage generating circuit, in which an output of the generating circuit is used for power sources of internal circuits.
Figure 8:
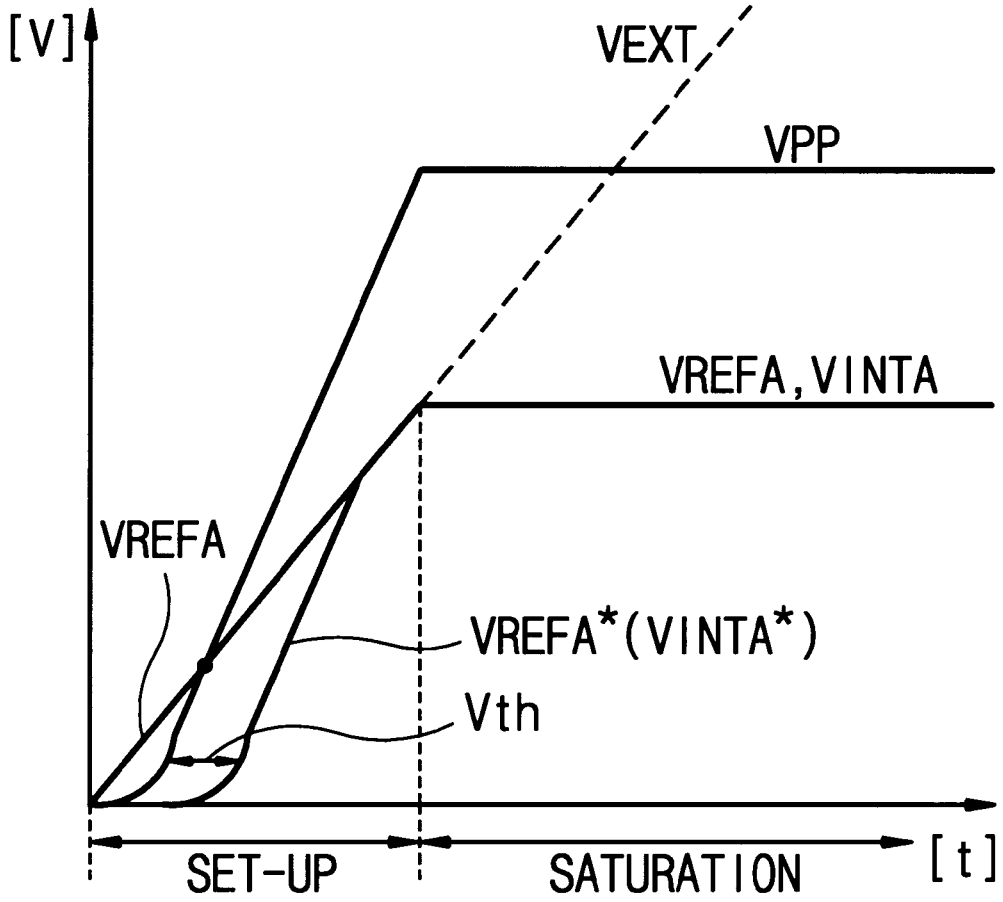
FIG. 8 is a graphic diagram showing the variations of a reference voltage, an internal power supply voltage and a boosted voltage, according to an increase of an external power supply voltage, when using the circuit of FIG. 6.

Now, an explanation about a generation of VINTA* from the circuit of FIG. 6 will be given in conjunction with the graphic chart of FIG. 8. Comparing the plotting feature of FIG. 8 with that of FIG. 4, a significant difference is that VINTA* is positioned at a lower zone under Vpp even in the set-up period. As shown in FIG. 8, in the set-up period, VREFA* moves from VREFA to a lower level by Vth (the threshold voltage of NMOS transistor M1 in FIG. 6). The shift of VREFA* is due to the NMOS transistor M1, and thereby VREFA* is put into a comparing loop with VINTA*. In the set-up period, i.e., while initiating the power-up, as VREFA* is forced to be lowered than VINTA*, node 72 goes to high level and then PMOS transistor M7 hardly switches on so as to prevent an increase of VINTA* therefrom. Thus, since VINTA* is lower than Vpp even when Vpp is still not pulled up to an usable voltage level, the creation of forward biasing from the source of a PMOS transistor to the bulk.

The value of threshold voltage of NMOS transistor M1, Vth, should be defined in a territory of that a voltage level of VREFA* is sufficient to generate VINTA* lower than Vpp at least in the set-up period, after voltage-dropping from VREFA through M1. Establishing the threshold voltage is to use several manufacturing methods that are well-known, such as to control a doping rate in a substrate or a channel size of the transistor. As described above, the present invention offers an advantage such that a latch-up occurring in a semiconductor memory device can be efficiently eliminated without increasing lay-out width.

In the drawings and specification, there have been disclosed typical preferred embodiments of the invention and, although specific terms are employed, they are used in a generic and descriptive sense only and not for purposes of limitation, the scope of the invention being set forth in the following claims.

That which is claimed is:

1. A circuit generating an internal power source voltage in a semiconductor memory device employing a boosted voltage, the circuit comprising:

a comparing circuit having an input terminal connected to the internal power source voltage and an output terminal connected to a transistor which charges the internal power source voltage; and a transistor connected between a reference voltage and another input of the comparing circuit.

2. A semiconductor memory device employing a boosted voltage, the device comprising:

an internal circuit including a PMOS transistor whose source is connected to an internal power source voltage and whose bulk is connected to the boosted voltage;

a circuit for generating the internal power source voltage, including a comparing circuit having an input terminal connected to the internal power source voltage and an output terminal connected to a transistor which charges the internal power source voltage; and a transistor connected between a reference voltage and another input of the comparing circuit.

3. An integrated power supply voltage generator, comprising:

a boosted voltage generator which generates a boosted voltage signal at a first level on a boosted voltage signal line during a set-up time interval, in response to an internal power supply voltage signal; and means, responsive to a first reference voltage and the boosted voltage signal, for generating the internal power supply voltage signal at a second level which is less than the first level throughout the set-up time interval.

4. The voltage generator of claim 3, wherein said generating means comprises:

a loading circuit which generates at an output thereof a second reference voltage having a magnitude less than a magnitude of the first reference voltage, upon application of the first reference voltage and the boosted voltage signal thereto; and a differential amplifier having a first input electrically coupled to the output of said loading circuit and a second input electrically coupled to an input of said boosted voltage generator.

5. The voltage generator of claim 4, wherein said loading circuit comprises a field effect transistor having a gate electrode which is electrically connected to the boosted voltage signal line and a source/drain region electrically connected to the first input of said differential amplifier.

6. The voltage generator of claim 4, further comprising an inverter having a PMOS transistor therein which is electrically coupled in series between the second input of said differential amplifier and an output of said inverter; and wherein a bulk region of the PMOS transistor is electrically connected to the boosted voltage signal line.

* * * * *